US005540165A

United States Patent [19]

Katou et al.

[11] Patent Number: 5,540,165

[45] Date of Patent: Jul. 30, 1996

[54] SEWING HEAD DRIVING APPARATUS FOR A SEWING MACHINE

[75] Inventors: Yutaka Katou, Kariya; Tadaaki Hashiride, Okazaki, both of Japan

[73] Assignee: Aisin Seiki Kabushiki Kaisha, Kariya, Japan

[21] Appl. No.: 420,509

[22] Filed: Apr. 12, 1995

[30] Foreign Application Priority Data

Apr. 13, 1994 [JP] Japan ..... 6-100738

[51] Int. Cl.[6] ..... D05B 69/02; D05B 69/30

[52] U.S. Cl. ..... 112/470.13; 112/259

[58] Field of Search ..... 112/470.12, 470.13, 112/220, 258, 259, 98, 2.1, 117

[56] References Cited

U.S. PATENT DOCUMENTS

| | | | |
|---|---|---|---|
| 320,849 | 6/1885 | Chase | 112/259 X |
| 361,426 | 4/1887 | Looker | 112/259 X |
| 3,595,188 | 7/1971 | Schmedding et al. | 112/98 X |
| 4,333,410 | 6/1982 | Taketomi | 112/259 X |
| 5,003,895 | 4/1991 | Talanker | 112/103 |
| 5,287,820 | 2/1994 | Stutznacker | 112/470.13 X |
| 5,322,027 | 6/1994 | Hashiride et al. | 112/220 |

FOREIGN PATENT DOCUMENTS 53-56539 5/1978 Japan .

54-149467 10/1979 Japan .

*Primary Examiner*—Ismael Izaguirre

*Attorney, Agent, or Firm*—Oblon, Spivak, McClelland, Maier, & Neustadt, P.C.

[57] ABSTRACT

The invention is directed to a sewing head driving apparatus for a sewing machine which has a table, a lower rotary shaft provided horizontally below a table, a sewing head provided above the table in spaced relationship therewith, an upper rotary shaft provided horizontally in the sewing head, a transmission mechanism for transmitting a rotational force to rotate the upper rotary shaft and the lower rotary shaft in synchronous relationship with each other, and a needle driving device for reciprocating a needle vertically in accordance with rotation of the upper rotary shaft. In the sewing head driving apparatus, a parallel motion device is provided to support the sewing head movably on a horizontal plane above the table, and move the sewing head between an initial position and a position horizontally apart from the initial position to provide an open area above the table at the initial position, and a synchronous relationship maintaining mechanism is provided to maintain the synchronous relationship between the upper rotary shaft and the lower rotary shaft, independent from the motion of the sewing head by the parallel motion device.

9 Claims, 4 Drawing Sheets

SEWING HEAD DRIVING APPARATUS FOR A SEWING MACHINE

BACKGROUND OF THE INVENTION

1. Field of the Invention

The present invention relates to a sewing head driving apparatus for a sewing machine, more particularly to an apparatus which is capable of moving the sewing head between an initial position and a predetermined position which is horizontally apart from the initial position.

2. Description of the Prior Art

In a conventional sewing machine for sewing a workpiece, e.g. a piece of cloth, or embroidering the cloth, a sewing head has been fixed to a certain position which is apart from a table by a predetermined distance. Therefore, when the cloth is set on the table, the sewing head stands in its way, so that operationability of the sewing machine is deteriorated. In view of this defect, it has been proposed to employ a rotary head system which is capable of rotating a head portion of a sewing machine arm to provide a space on a table, in Japanese Patent Laid-open Publication No. 53-56539. Also, it has been proposed in Japanese Utility Model Application No. 54-149467 to employ a sewing head rotating apparatus which is provided with a positioning mechanism for installing the sewing head rotatably on a cylindrical support which is concentric with respect to an upper shaft mounted on an upper frame, and holding the sewing head at a sewing position (working position) or a waiting position rotated from the sewing position about the axis of the upper shaft by a predetermined angle, and which is provided with a driving device for rotating the sewing head.

According to the apparatuses disclosed in the above-described publications, when the cloth is set on the table, the needle driving device does not stand in its way, so that the operationability will be improved a little comparing with the prior apparatus. However, only a needle driving device mounted on the tip end of the sewing head rotates with respect to the table. That is, the main body of the sewing head is retained above a needle plate mounted on the table. Therefore, it is impossible to set the cloth on the table from a position above the needle plate, and impossible to ascertain or watch the set condition of the cloth from that position. In addition, it is not easy to change the needle plate, or adjust the shuttle mechanism or the like. In order to provide an open area above the needle plate, it is necessary to move the sewing head on the horizontal plane, maintaining synchronous relationship between the upper shaft provided for moving the needle vertically and the lower shaft provided for moving the shuttle mechanism. Therefore, with the sewing head simply caused to be movable or rotatable on a horizontal plane, it is impossible to cause the sewing head to maintain the synchronous relationship between the upper shaft and the lower shaft, so that it is impossible to provide a practical apparatus.

SUMMARY OF THE INVENTION

Accordingly, it is an object of the present invention to provide a sewing head driving apparatus for driving a sewing head to be movable between an initial position and a position which is apart from the initial position by a predetermined distance on a horizontal plane, maintaining the upper and lower shafts of the sewing machine in synchronous relationship with each other.

It is another object of the present invention to provide a sewing head driving apparatus for driving a sewing head to be movable between the initial position and the position which is angularly apart from the initial position by a predetermined angle, and placing the sewing head in synchronous relationship between the upper shaft and lower shaft at the initial positions of the upper and lower shafts.

In accomplishing these and other objects, a sewing head driving apparatus is provided for a sewing machine which has a table, a lower rotary shaft provided horizontally below a table, a sewing head provided above the table in spaced relationship therewith, an upper rotary shaft provided horizontally in the sewing head, transmission means for transmitting a rotational force to rotate the upper rotary shaft and the lower rotary shaft in synchronous relationship with each other, and needle driving means for reciprocating a needle vertically in accordance with rotation of the upper rotary shaft. In the sewing head driving apparatus, parallel motion means is provided to support the sewing head movably on a horizontal plane above the table apart therefrom by a predetermined distance, and move the sewing head between an initial position and a position horizontally apart from the initial position to provide an open area above the table at the initial position. And, synchronous relationship maintaining means is provided to maintain the synchronous relationship between the upper rotary shaft and the lower rotary shaft, independent from the motion of the sewing head by the parallel motion means.

The parallel motion means may comprise a guide rail which is provided above the table perpendicularly to the upper rotary shaft for mounting the sewing head slidably on the guide rail, and first head driving means which is provided to move the sewing head along the guide rail.

The synchronous relationship maintaining means may comprise a spline shaft which is provided above the table perpendicularly to the upper rotary shaft, a first gear having a boss portion which is formed on the central axis thereof and slidably mounted on the spline shaft, and a second gear which is meshed with the first gear and connected to the upper rotary shaft for rotating the upper rotary shaft, and the transmission means may be arranged to transmit the rotational force to the lower rotary shaft and the spline shaft through the first and second gears to rotate the upper rotary shaft.

The sewing head driving apparatus may have a sewing head which is mounted rotatably on the horizontal plane above the table, and may include a vertical rotary shaft which is operatively connected to the upper rotary shaft and the lower rotary shaft for rotating the upper rotary shaft and the lower rotary shaft in synchronous relationship with each other through the vertical rotary shaft, and include second head driving means which is provided to rotate the sewing head about the vertical rotary shaft, independent from the transmission means.

The second head driving means may comprise a cylindrical rotary member which is secured to the sewing head, and which has a hollow portion through which the vertical rotary shaft is provided, and rotating means which is operatively connected to the rotary member so as to rotate the rotary member about the vertical rotary shaft.

It is preferable to further include a cylindrical support member which is secured to the table so as to receive therein and rotatably mount the rotary member. The rotating means may include a motor which is secured to the support member so as to rotate the rotary member.

BRIEF DESCRIPTION OF THE DRAWINGS

The above stated objects and following description will become readily apparent with reference to the accompanying drawings, wherein like reference numerals denote like elements, and in which.

DESCRIPTION OF THE PREFERRED EMBODIMENT

Figure 1:
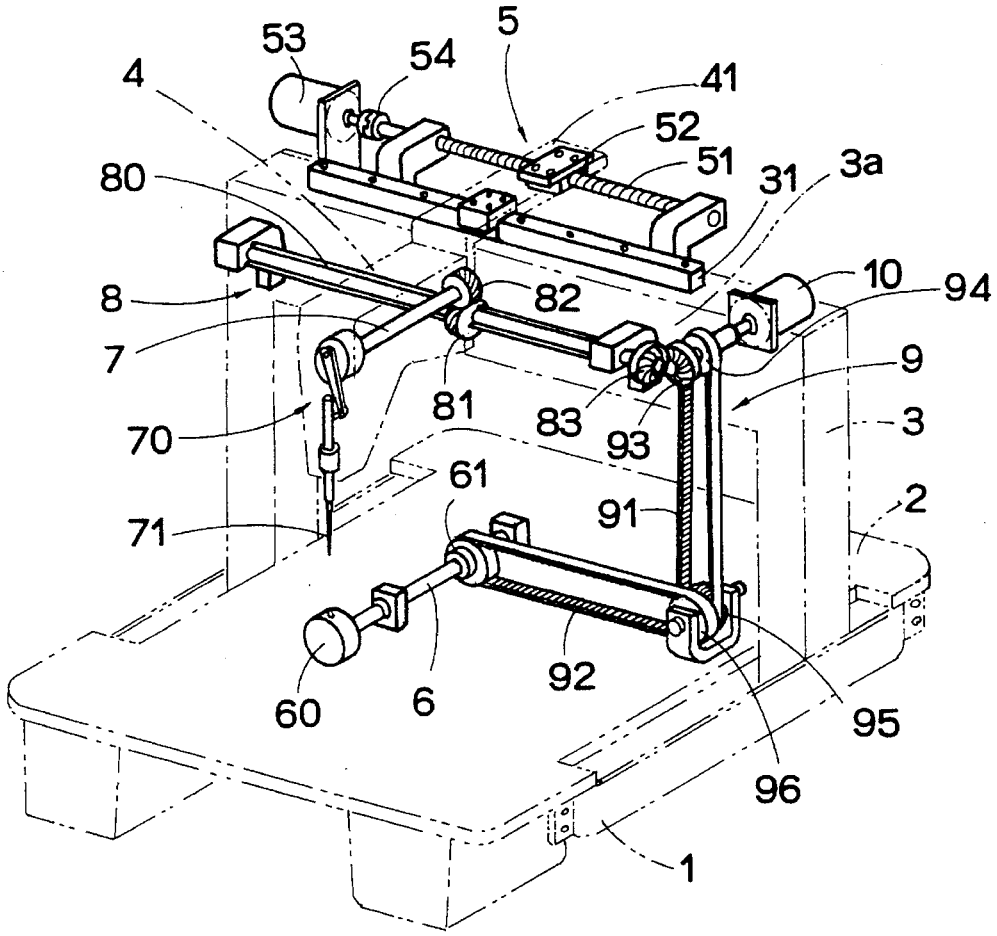
FIG. 1 is a perspective view showing a mechanism of a sewing head driving apparatus according to an embodiment of the present invention.
Figure 3:
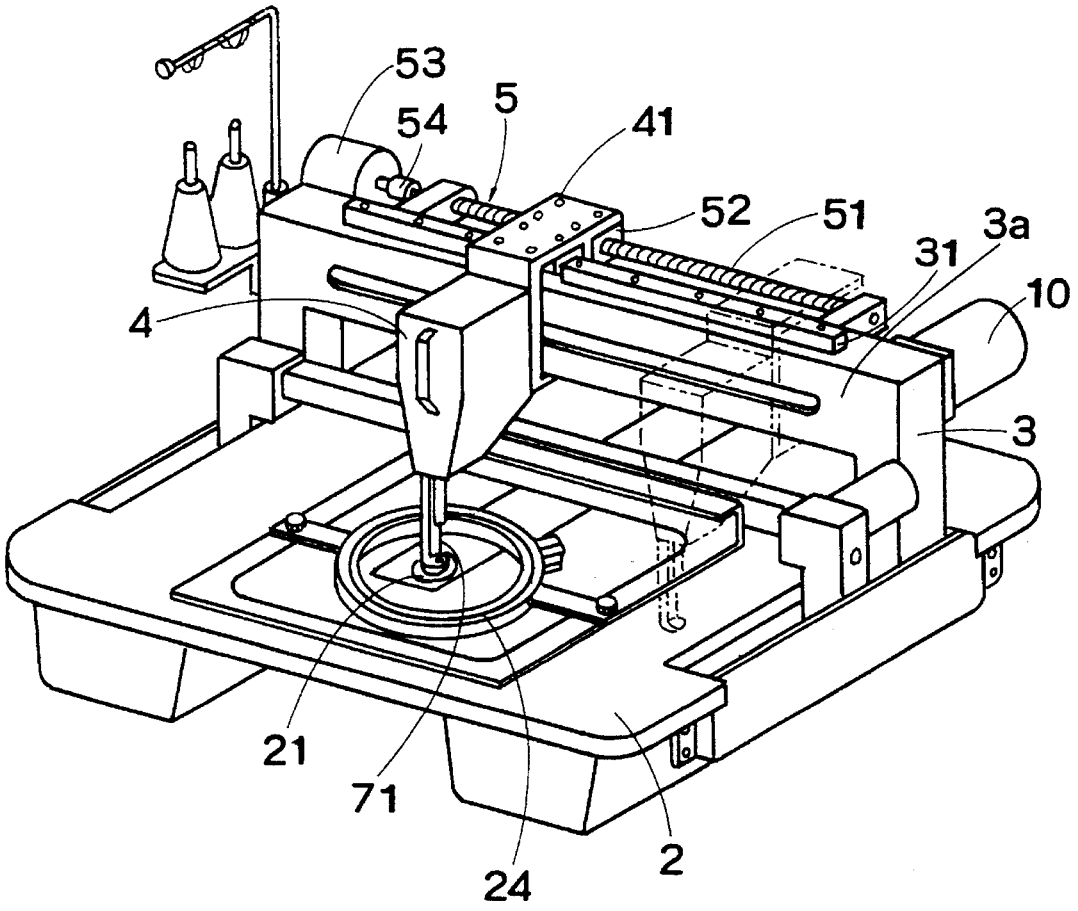
FIG. 3 is a perspective view of a sewing machine having a sewing head driving apparatus according to an embodiment of the present invention.

Referring to FIG. 1, there is illustrated a mechanism of a sewing head driving apparatus for use in a sewing machine as shown in FIG. 3 for embroidering a workpiece, or a piece of cloth, according to an embodiment of the present invention. A table 2 is mounted on a base 1, and a flat arch gate-like frame 3 is fixedly secured to the base 1. A beam 3*a* for constituting a part of the frame 3 is laid in parallel with the table 2 to support a sewing head 4 so as to be movable on a horizontal plane between an initial position as indicated by a solid line in FIG. 3 and a predetermined position as indicated by a two-dotted chain line, for example. A support member 41 is slidably mounted on a guide rail 31 of so-called linear guide, which is secured to the beam 3*a*, through a parallel motion device 5 which will be described later. The sewing head 4 is secured to the support member 41 to move together therewith on the beam 3*a*. In this respect, the apparatus as shown in FIG. 1 has been enlarged or shifted in part, compared with the one as shown in FIG. 3 for easy understanding of its mechanism.

The parallel motion device 5 includes a ball screw mechanism, having a screw shaft 51 which is provided in parallel with the guide rail 31 and secured to the beam 3*a* through brackets, and a ball nut 52 meshed with the screw shaft 51 to move along the axis thereof. The ball nut 52 is provided therein with a plurality of balls (not shown) along the groove of the screw shaft 51, and secured to the support member 41. The screw shaft 51 is rotatably mounted on the beam 3*a* at its opposite end portions, one of which is linked with a sewing head driving motor 53 (hereinafter, simply referred to as motor 53) through a coupling 54. Therefore, as the screw shaft 51 is rotated by the motor 53, the ball nut 52 is moved in the left or right direction in FIGS. 1 and 3 in accordance with a rotational direction of the screw shaft 51, so that the support member 41 and the sewing head 4, which are fixed to the ball nut 52, come to move along the guide rail 31.

A lower rotary shaft 6 (hereinafter, referred to as lower shaft 6) is rotatably mounted under the central portion of the table 2 along an axis perpendicular to the beam 3*a*. The lower shaft 6 is connected at its one end with a shuttle mechanism 60, and provided with a pulley 61 which is secured to its intermediate portion. On the table 2 above the shuttle mechanism 60, there is provided a needle plate 21 as shown in FIG. 3, and an upper rotary shaft 7 (hereinafter, referred to as upper shaft 7) is provided so as to locate a needle 71 on the vertical axis which includes the center of a needle hole defined in the needle plate 21. That is, the upper shaft 7 is supported in parallel with the lower shaft 6, and provided at its tip end with a needle driving mechanism 70.

The needle driving mechanism 70 is adapted to convert the rotational motion of the upper rotary shaft 7 into reciprocating motion of the needle 71 vertically to the table 2. Another end of the upper shaft 7 is connected with a synchronous relationship maintaining mechanism 8 (hereinafter, simply referred to as synchronous mechanism 8), and further connected with a machine driving motor 10 (hereinafter, driving motor 10) and the lower shaft 6 as well, through a transmission mechanism 9.

As shown in FIG. 1, the synchronous mechanism 8 includes a spline shaft 80 which is rotatably mounted on the beam 3*a* in parallel with the guide rail 31, and a first gear 81 which is formed at the center with a boss portion 81*a* (shown in FIG. 2) which is slidably mounted on the spline shaft 80. The spline shaft 80 has one end thereof secured to a gear 83 which is meshed with a gear 93 of the transmission mechanism 9. The first gear 81 may be of a screw gear, for example, and adapted to be meshed with a second gear 82 of another screw gear, for example. The first and second gears 81, 82 may be of bevel gears, and the gear 83, 93 may be of bevel gears, or screw gears to be meshed with each other.

Figure 2:
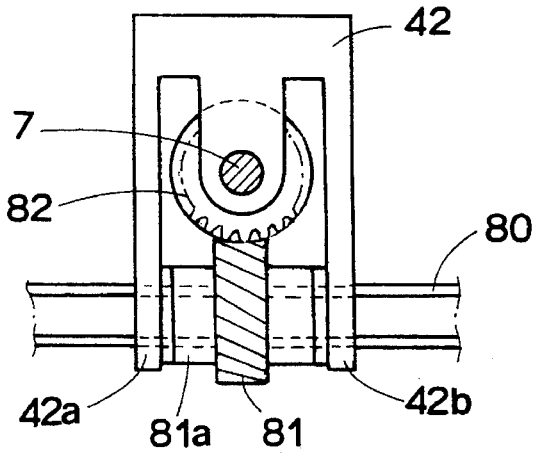
FIG. 2 is a partially sectioned front view showing a synchronous relationship maintaining mechanism of a sewing head driving apparatus according to an embodiment of the present invention.

The upper shaft 7 is rotatably mounted on a housing 42 of the sewing head 4 as shown in FIG. 2, so that the second gear 82 rotates about the axis of the upper shaft 7. The first gear 81 is slidably mounted on the spline shaft 80, and held between wall portions 42*a*, 42*b* of the housing 42. Accordingly, as the support member 41 moves along the guide rail 31 which is parallel with the spline shaft 80, the first gear 81 slides on the spline shaft 80 to move together with the sewing head 4. In this case, since the first gear 81 is mounted on the spline shaft 80 through the boss portion 81*a*, such a relation that the rotational force of the spline shaft 80 is transmitted to the second gear 82 through the first gear 81 is maintained.

The transmission mechanism 9 is adapted to transmit the rotational force generated by the motor 10, which is mounted on the upper portion of the frame 3, to the lower shaft 6 and the upper shaft 7. According to the transmission mechanism 9 in the present embodiment, the lower shaft 6 is connected to the spline shaft 80 (and then to the upper shaft 7) through toothed transmission belts, or timing belts 91, 92 (hereinafter, simply referred to as belts 91, 92). That is, the gear 93 and the pulley 94 are secured to a rotary output shaft of the motor 10. The gear 93 is arranged to be meshed with the gear 83 which is mounted on the spline shaft 80, and the pulley 94 is connected to a pulley 95, which is rotatably mounted on the base 1, through the belt 91. Furthermore, a pulley 96 is mounted coaxially with the pulley 95 to rotate together with the pulley 95, and connected to a pulley 61, which is secured to the lower shaft 6, through the belt 92. As the gear 93 and pulley 94 are rotated by the motor 10, the upper shaft 7 is rotated through the gear 83, the spline shaft 80, the first and second gears 81, 82, while the lower shaft 6 is rotated through the belts 91, 92, the pulleys 95, 96, and the pulley 61. The mechanism for moving an embroidering frame 24 on the X-Y plane of the table 2 does not directly relate to the present invention, so that the explanation about it is omitted herein.

In operation, the motor 53 is driven to rotate the screw shaft 51, so that the sewing head 4 moves to the position as indicated by the two-dotted chain line in FIG. 3 along the guide rail 31 to provide an open area above the sewing head 4. Whereby, a piece of cloth may be easily placed on the needle plate 21 from a position above the needle plate 21, and held with the embroidering frame 24 (FIG. 3). Also, change of the needle plate 21, adjustment of the shuttle mechanism 60 or the like may be easily carried out. After the cloth is placed on the needle plate 21, the motor 53 is driven in the reverse direction, the sewing head 4 returns to its initial position as indicated by the solid line in FIG. 3, so that the needle 71 comes to be located above the needle plate 21. In this condition, as the motor 10 is driven to rotate the lower shaft 6 through the pulley 94, belt 91, pulleys 95, 96, belt 92 and pulley 61, the shuttle mechanism 60 is driven as well, and also the upper shaft 7 is rotated through the gears 93, 83, spline 80, the first and second gears 81, 82, and further converted into the vertical reciprocating motion of the needle 71 through the needle driving mechanism 70 to embroider the cloth. Thus, with the spline shaft 80, the first and second gears 81, 82 of the synchronous mechanism 8, the sewing head 4 is capable of moving along the spline shaft 80, holding the condition where the upper shaft 7 is capable of rotating in synchronous relationship with rotation of the lower shaft 6.

Figure 4:
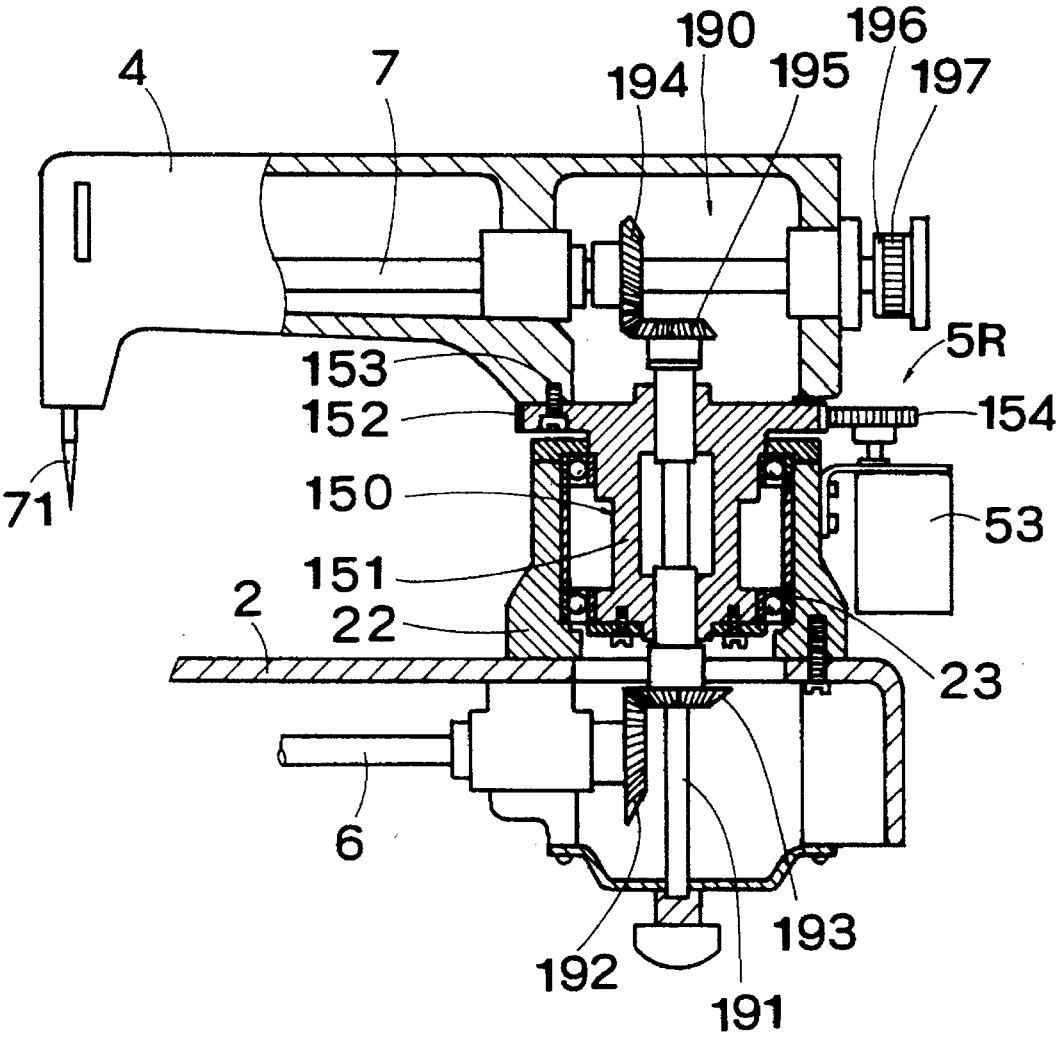
FIG. 4 is a perspective view showing a driving mechanism of a sewing head driving apparatus according to another embodiment of the present invention.
Figure 5:
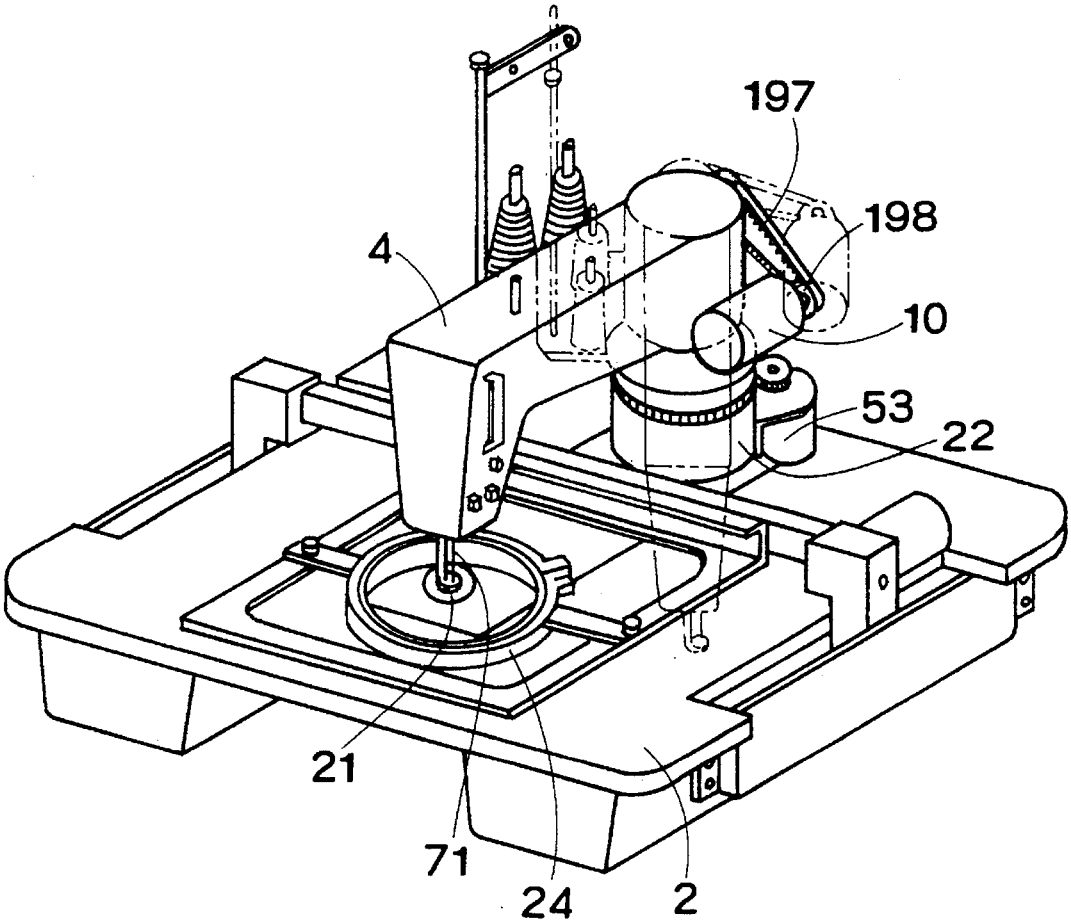
FIG. 5 is a perspective view of a sewing machine having a sewing head driving apparatus according to another embodiment of the present invention.

FIGS. 4 and 5 illustrate a sewing head driving apparatus according to another embodiment of the present invention, wherein the sewing head 4 is adapted to be rotated by a head driving device 5R from the initial position to a position where the sewing head 4 is rotated by a predetermined angle as indicated by a two-dotted chain line in FIG. 5. Parts having the same reference numerals as those in FIGS. 1 to 3 are substantially the same as the parts disclosed therein. In this embodiment, the lower rotary shaft 6 and upper rotary shaft 7 are connected with each other through a vertical rotary shaft 191 (hereinafter, referred to as vertical shaft 191). The head driving device 5R is provided with a rotary member 150, which is secured to the sewing head 4, and which is supported by a cylindrical support member 22 secured to the table 2, so as to rotate about the vertical shaft 191. Therefore, the sewing head 4 is capable of rotating about the vertical shaft 191, with respect to the table 2.

The rotary member 150 is formed in a cylindrical shape, and through its hollow portion the vertical shaft 191 is provided. The main body 151 of the rotary member 150 is rotatably mounted on the support member 22 through a pair of bearings 23. On one end portion of the rotary member 150, there is provided a spur gear 152 which is secured to the head portion 4 by a bolt 153. Therefore, the rotary member 150 rotates integrally with the sewing head 4, with respect to the support member 22. The motor 53 is so arranged that a spur gear 154 secured to its output shaft meshes with the spur gear 152 of the rotary member 150.

The vertical shaft 191 extends out of the rotary member 150 to secure bevel gears 193, 195 at its opposite ends respectively. The bevel gear 193 is arranged to mesh with a bevel gear 192 which is secured to one end portion of the lower rotary shaft 6, while the bevel gear 195 is arranged to mesh with a bevel gear 194 which is fixed to an intermediate portion of the upper rotary shaft 7. The upper rotary shaft 7 extends out of the housing of the sewing head 4 to secure at its tip end portion a pulley 196, which is connected with a pulley 198 (FIG. 5) secured to the output shaft of the motor 10, through a toothed transmission belt 197. The machine driving motor 10 in this embodiment is secured to the side surface of the sewing head 4.

Accordingly, in order to embroider a piece of cloth by the above-described apparatus according to this embodiment, the motor 53 is driven at the outset to rotate the rotary member 150. As the sewing head 4 rotates about the vertical shaft 191 to be located at a position as indicated by the two-dotted chain line in FIG.5, an open area is provided above the sewing head 4. In this case, the upper shaft 7 is in its stopped condition, because the motor 10 has not been driven, whereas the lower rotary shaft 6 is freely movable, so that the lower rotary shaft 6 rotates in accordance with rotation of the sewing head 4. Whereby, a piece of cloth may be easily placed on the needle plate 21, and held with the embroidering frame 24 (FIG. 5). Also, change of the needle plate, adjustment of the shuttle mechanism or the like may be easily carried out. After the cloth is placed on the needle plate 21, the motor 53 is driven in the reverse direction, the sewing head 4 returns to its initial position as indicated by the solid line in FIG. 5, so that the needle 71 comes to be located above the needle plate 21. In this condition, the motor 10 has been stopped, the upper rotary shaft 7 does not rotate, so that the lower rotary shaft 6 in its freely movable condition rotates in accordance with rotation of the sewing head 4, and returns to the same condition as the condition with respect to the upper rotary shaft 7 at its initial position. Then, as the motor 10 is driven to rotate the upper rotary shaft 7 through the pulley 198, belt 197, and pulley 196, rotation of the upper rotary shaft 7 is converted into vertical motion of the needle 71 through a needle driving mechanism (omitted in FIG. 4), and the lower rotary shaft 6 is rotated through the spur gears 194, 195, 193, 192, so that a shuttle mechanism (omitted in FIG. 4) is driven to embroider the cloth.

It should be apparent to one skilled in the art that the above-described embodiments are merely illustrative of but two of the many possible specific embodiments of the present invention. Numerous and various other arrangements can be readily devised by those skilled in the art without departing from the spirit and scope of the invention as defined in the following claims.

What is claimed is:

1. A sewing head driving apparatus for a sewing machine having a table, a lower rotary shaft provided horizontally below a table, a sewing head provided above said table in spaced relationship therewith, an upper rotary shaft provided horizontally in said sewing head, transmission means for transmitting a rotational force to rotate said upper rotary shaft and said lower rotary shaft in synchronous relationship with each other, and needle driving means for reciprocating a needle vertically in accordance with rotation of said upper rotary shaft, comprising:

parallel motion means for supporting said sewing head movably on a horizontal plane above said table apart therefrom by a predetermined distance, and moving said sewing head between an initial position and a position horizontally apart from said initial position to provide an open area above said table at said initial position; and synchronous relationship maintaining means for maintaining the synchronous relationship between said upper rotary shaft and said lower rotary shaft, independent from the motion of said sewing head by said parallel motion means;

wherein said parallel motion means comprises:

a guide rail provided above said table perpendicularly to said upper rotary shaft for mounting said sewing head slidably on said guide rail; and first head driving means for moving said sewing head along said guide rail;

wherein said first head driving means comprises:

a screw shaft provided in parallel with said guide rail;

a nut meshed with said screw shaft and fixed to said sewing head for moving said sewing head along the axis of said screw shaft; and a motor for rotating said screw shaft about the axis thereof.

2. A sewing head driving apparatus for a sewing machine having a table, a lower rotary shaft provided horizontally below a table, a sewing head provided above said table in spaced relationship therewith, an upper rotary shaft provided horizontally in said sewing head, transmission means for transmitting a rotational force to rotate said upper rotary shaft and said lower rotary shaft in synchronous relationship with each other, and needle driving means for reciprocating a needle vertically in accordance with rotation of said upper rotary shaft, comprising:

parallel motion means for supporting said sewing head movably on a horizontal plane above said table apart therefrom by a predetermined distance, and moving said sewing head between an initial position and a position horizontally apart from said initial position to provide an open area above said table at said initial position; and synchronous relationship maintaining means for maintaining the synchronous relationship between said upper rotary shaft and said lower rotary shaft, independent from the motion of said sewing head by said parallel motion means;

wherein said synchronous relationship maintaining means comprises:

a spline shaft provided above said table perpendicularly to said upper rotary shaft;

a first gear slidably mounted on said spline shaft; and a second gear meshed with said first gear and connected to said upper rotary shaft for rotating said upper rotary shaft, and wherein said transmission means transmits the rotational force to said lower rotary shaft and said spline shaft through said first and second gears to rotate said upper rotary shaft.

3. The apparatus as defined in claim 2, wherein said sewing head has a housing connected to said parallel motion means, said housing rotatably mounting thereon said upper rotary shaft and holding said first gear in said housing.

4. A sewing head driving apparatus for a sewing machine having a table, a lower rotary shaft provided horizontally below a table, a sewing head provided above said table in spaced relationship therewith, an upper rotary shaft provided horizontally in said sewing head, transmission means for transmitting a rotational force to rotate said upper rotary shaft and said lower rotary shaft in synchronous relationship with each other, and needle driving means for reciprocating a needle vertically in accordance with rotation of said upper rotary shaft, comprising:

parallel motion means for supporting said sewing head movably on a horizontal plane above said table apart therefrom by a predetermined distance, and moving said sewing head between an initial position and position horizontally apart from said initial position to provide an open area above said table at said initial position; and synchronous relationship maintaining means for maintaining the synchronous relationship between said upper rotary shaft and said lower rotary shaft, independent from the motion of said sewing head by said parallel motion means;

wherein said parallel motion means comprises:

a guide rail provided above said table perpendicularly to said upper rotary shaft for mounting said sewing head slidably on said guide rail;

a screw shaft provided in parallel with said guide rail;

a nut meshed with said screw shaft and fixed to said sewing head for moving said sewing head along the axis of said screw shaft; and a motor for rotating said screw shaft about the axis thereof;

wherein said synchronous relationship maintaining means comprises:

a spline shaft provided above said table in parallel with said guide rail, and perpendicularly to said upper rotary shaft;

a first gear having a boss portion formed on the central axis thereof and slidably mounted on said spline shaft; and a second gear meshed with said first gear and connected to said upper rotary shaft for rotating said upper rotary shaft, and wherein said transmission means transmits the rotational force to said lower rotary shaft and said spline shaft through said first and second gears to rotate said upper rotary shaft.

5. A sewing head driving apparatus for a sewing machine having a table, a lower rosary shaft provided horizontally below a table, a sewing head provided above said table in spaced relationship therewith, an upper rotary shaft provided horizontally in said sewing head, transmission means for transmitting a rotational force to rotate said upper rotary shaft and said lower rotary shaft in synchronous relationship with each other, and needle driving means for reciprocating a needle vertically in accordance with rotation of said upper rotary shaft, comprising:

parallel motion means for supporting said sewing head movably on a horizontal plane above said table apart therefrom by a predetermined distance, and moving said sewing head between an initial position and a position horizontally apart from said initial position to provide an open area above said table at said initial position; and synchronous relationship maintaining means for maintaining the synchronous relationship between said upper rotary shaft and said lower rotary shaft, independent from the motion of said sewing head by said parallel motion means;

wherein said sewing head is mounted rotatably on the horizontal plane above said table, and wherein said synchronous relationship maintaining means includes a vertical rotary shaft operatively connected to said upper rotary shaft and said lower rotary shaft for rotating said upper rotary shaft and said lower rotary shaft in synchronous relationship with each other through said vertical rotary shaft, and said parallel motion means includes second head driving means for rotating said sewing head about said vertical rotary shaft, independent from said transmission means.

6. The apparatus as defined in claim 5, wherein said second head driving means comprises:

a cylindrical rotary member secured to said sewing head, said rotary member having a hollow portion through which said vertical rotary shaft is provided; and rotating means operatively connected to said rotary member for rotating said rotary member about said vertical rotary shaft.

7. The apparatus as defined in claim 6, further comprising a cylindrical support member secured to said table for receiving therein and rotatably mounting said rotary member, said rotating means including a motor secured to said support member for rotating said rotary member.

8. The apparatus as defined in claim 5, wherein a gear is secured to each of said upper and lower rotary shafts, and wherein a pair of gears are secured to said vertical rotary shaft to be meshed with each gear of said upper and lower rotary shafts, respectively.

9. A sewing head driving apparatus for a sewing machine having a table, a lower rotary shaft provided horizontally below a table, a sewing head provided above said table in spaced relationship therewith, an upper rotary shaft provided horizontally in said sewing head, transmission means for transmitting a rotational force to rotate said upper rotary shaft and said lower rotary shaft in synchronous relationship with each other, and needle driving means for reciprocating a needle vertically in accordance with rotation of said upper rotary shaft, comprising:

parallel motion means for supporting said sewing head movably on a horizontal plane above said table apart therefrom by a predetermined distance, and moving said sewing head between an initial position and a position horizontally apart from said initial position to provide an open area above said table at said initial position; and synchronous relationship maintaining means for maintaining the synchronous relationship between said upper rotary shaft and said lower rotary shaft, independent from the motion of said sewing head by said parallel motion means;

wherein said sewing head is mounted rotatably on the horizontal plane above said table, and wherein said synchronous relationship maintaining means comprises:

a vertical rotary shaft operatively connected to said upper rotary shaft and said lower rotary shaft for rotating said upper rotary shaft and said lower rotary shaft in synchronous relationship with each other through said vertical rotary shaft, each of said upper and lower rotary shafts having a gear secured thereto, and said vertical rotary shaft having a pair of gears secured thereto for meshing with each gear of said upper and lower rotary shafts, respectively; and said parallel motion means comprises:

a cylindrical rotary member secured to said sewing head, said rotary member having a hollow portion through which said vertical rotary shaft is provided;

a cylindrical support member secured to said table for receiving therein and rotatably mounting said rotary member; and a motor secured to said support member and operatively connected to said rotary member for rotating said rotary member about said vertical rotary shaft.

* * * * *